US008724286B2

(12) United States Patent
Uchida et al.

(10) Patent No.: US 8,724,286 B2
(45) Date of Patent: May 13, 2014

(54) IONIZER HAVING CLEANING SYSTEM

(75) Inventors: Hideki Uchida, Tokyo (JP); Hideya Maki, Tokyo (JP); Toshikazu Numaguchi, Tokyo (JP); Masahiko Ito, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 291 days.

(21) Appl. No.: 12/671,430

(22) PCT Filed: Aug. 11, 2008

(86) PCT No.: PCT/US2008/072781

§ 371 (c)(1),
(2), (4) Date: Jan. 29, 2010

(87) PCT Pub. No.: WO2009/026023

PCT Pub. Date: Feb. 26, 2009

(65) Prior Publication Data

US 2010/0188793 A1 Jul. 29, 2010

(30) Foreign Application Priority Data

Aug. 23, 2007 (JP) ..... 2007-217268

(51) Int. Cl.
*H01T 23/00* (2006.01)

(52) U.S. Cl.
USPC ..... 361/230

(58) Field of Classification Search
USPC ..... 361/230–233
See application file for complete search history.

(56) References Cited

U.S. PATENT DOCUMENTS

| | | | | |
|---|---|---|---|---|
| 4,370,604 | A * | 1/1983 | Griffin | 318/687 |
| 4,734,580 | A * | 3/1988 | Rodrigo et al. | 250/324 |
| 2,012,093 | A | 4/1991 | Shimizu | |
| 5,153,811 | A | 10/1992 | Rodrigo et al. | |
| 5,768,087 | A | 6/1998 | Vernitskiy | |
| 6,238,124 | B1 * | 5/2001 | Merlo | 403/93 |

FOREIGN PATENT DOCUMENTS

| | | |
|---|---|---|
| JP | 2002271905 | 9/2002 |
| JP | 2003-163097 | 6/2003 |
| JP | 2003-332022 | 11/2003 |
| JP | 2004-234972 | 8/2004 |
| JP | 2007-123167 | 5/2007 |

* cited by examiner

*Primary Examiner* — Rexford Barnie
*Assistant Examiner* — Christopher Clark
(74) *Attorney, Agent, or Firm* — Robert S. Moshrefzadeh

(57) ABSTRACT

An object of the present invention is to provide an ionizer having a cleaning system for cleaning an electrode needle of the ionizer automatically or remotely, while also being compact in size. The cleaning system (6) has a rotating member (61) configured to coaxially rotate with the fan (3), a plurality of rods (62*a* to 62*d*) attached to the rotating member (61) such that each rod extends radially from the rotating member, and brushes (63*a* to 63*d*) each attached to the end of each rod. The rotating member (61) is driven by an electromagnetic solenoid (64) via a coupling means (66).

7 Claims, 5 Drawing Sheets

II - II SECTION

V-V SECTION

IONIZER HAVING CLEANING SYSTEM

TECHNICAL FIELD

The present invention relates to an ionizer having a cleaning system for cleaning an electrode needle of the ionizer.

BACKGROUND

Various types of ion generator or ionizer, for generating air ions by corona discharging and for neutralizing static electricity on an object with air flow including the air ions by means of a fan, have been developed. Such a type of ionizer has an electrode needle (or a discharging needle) for generating corona discharging. The discharging performance of the electrode needle may be deteriorated, after use, when dust in the air is adsorbed on the tip of the needle. Therefore, it is necessary to clean the electrode needle periodically. For example, Japanese Unexamined Patent Publication (Kokai) No. 2004-234972 discloses an air-flow type ionizer and describes that "a fin portion receives an air flow and a movable member is activated. Then, a brush member attached to the movable member comes into contact with the tip of a discharging needle, whereby the dust adsorbed on the tip of the needle is removed". Also, Japanese Unexamined Patent Publication (Kokai) No. 2004-234972 describes that "a cleaning means may be configured to be activated by an electric motor".

On the other hand, U.S. Patent Publication No. 5,768,087 discloses "a cleaning device for automatically cleaning dust and dirt from ionizing electrodes", and describes that "The cleaning device generally comprises a brush assembly, a weighted portion and a restoring mechanism". In addition, an air ionizer (Model Number: BF-27C), having a brush for cleaning an electrode needle and a photoelectric tube for detecting the position of the brush, is commercially available from SHISHIDO Electrostatic Ltd.

SUMMARY

As described above, it is necessary to clean the electrode needle of the ionizer at a proper time interval. However, the ionizer may be used in a system, such as semiconductor production equipment, which is continuously operated for a considerably long time. In such a case, it should be avoided, as far as possible, to stop the system for only cleaning the electrode needle, in view of the efficiency. Therefore, it is desired to clean the electrode needle automatically or remotely.

In many cases, the installation site of the ionizer in the semiconductor production equipment or the like is positioned in a narrow space. Therefore, the ionizer is desired to be compact in size, in particular, to be thin in the air flow direction, while exerting a certain performance (concretely, the sufficient volume of air flow). Accordingly, the ionizer is desired to not be larger, in particular, not be thick in the air flow direction, due to the existence of a means for cleaning the electrode needle. The ionizer is also desired to keep the certain volume of air flow of a fan of the ionizer, in other words, any member is not positioned in front of the fan, which may be an obstacle to the air flow. In addition, the cleaning means such as a brush is desired to move sufficiently away from the electrode needle, without using an intricate circuit or the like, during the operation of the ionizer.

An object of the present invention is thus to provide an ionizer having a cleaning system for cleaning an electrode needle of the ionizer automatically or remotely, while also being compact in size.

In order to achieve the object of the invention described above, according to one aspect of the invention, there is provided an ionizer comprising: at least one electrode needle for generating air ions by corona discharging; an air conveying means for generating an air flow by which the air ions are conveyed; and a cleaning system for cleaning the electrode needle, wherein the cleaning system comprises: a cleaning member configured to come into contact with the electrode needle; and an actuator configured to move the cleaning member to the electrode needle.

According to another aspect of the invention there is provided an ionizer comprising: at least two electrode needles for generating air ions by corona discharging; an air conveying means for generating an air flow by which the air ions are conveyed; and a cleaning system for cleaning the electrode needles, wherein the cleaning system comprises a first brush configured to come into contact with one electrode needle and a second brush configured to come into contact with another electrode needle, and wherein the first and second brush are configured to come into contact with corresponding electrode needle at the different timing each other.

In the ionizer according to one aspect of the invention, the brush is moved by the actuator, whereby the moving range and the stopping position of the brush may be controlled without using an intricate mechanism.

In the ionizer according to the other aspect of the invention, all of the brushes do not simultaneously come into contact with corresponding electrode needle, whereby the actuator for driving the cleaning system may have a compact size and a low power.

DETAILED DESCRIPTION

Figure 1:
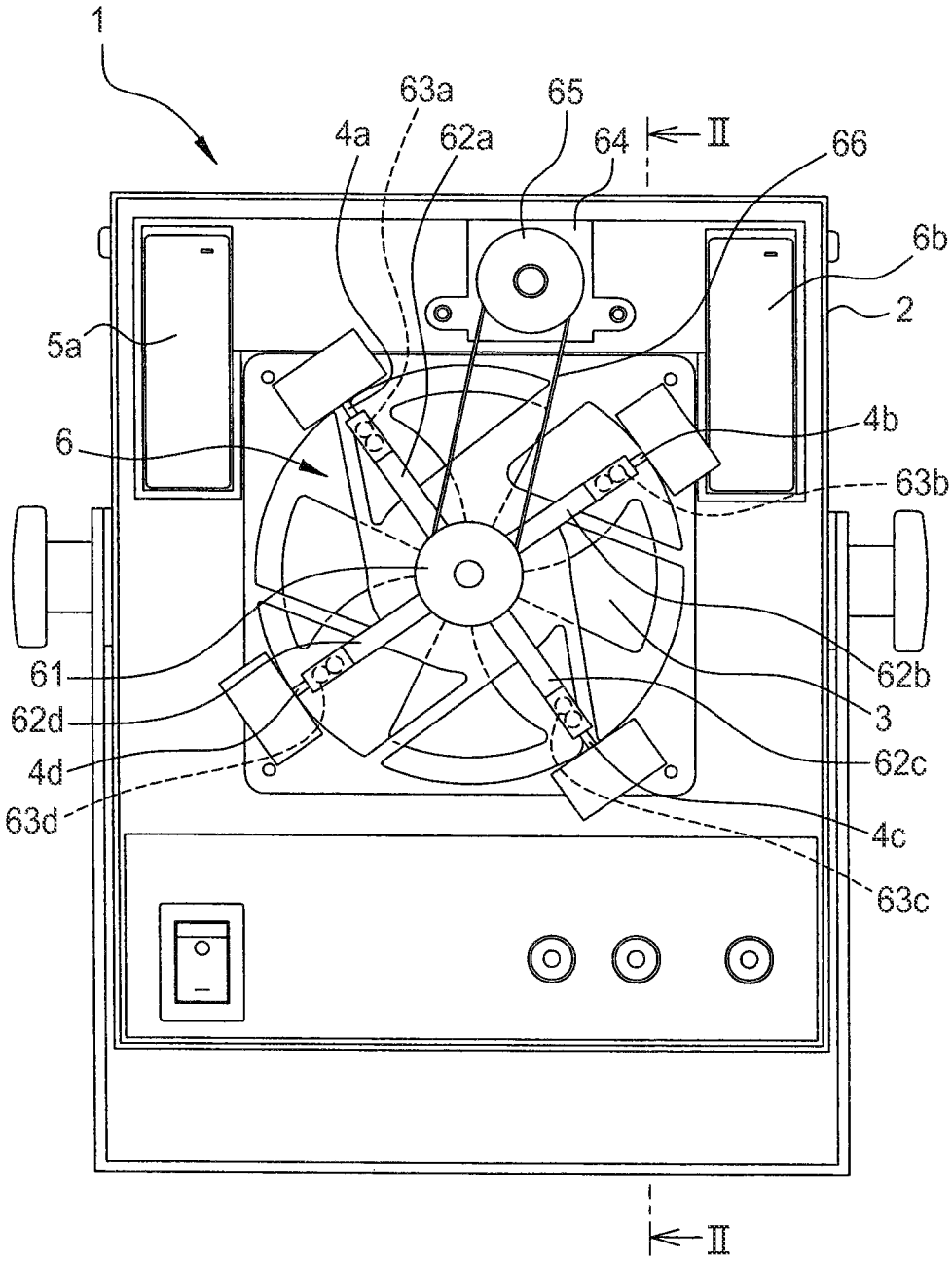
FIG. 1 is a top view of an ionizer according to a first embodiment of the present invention.
Figure 2:
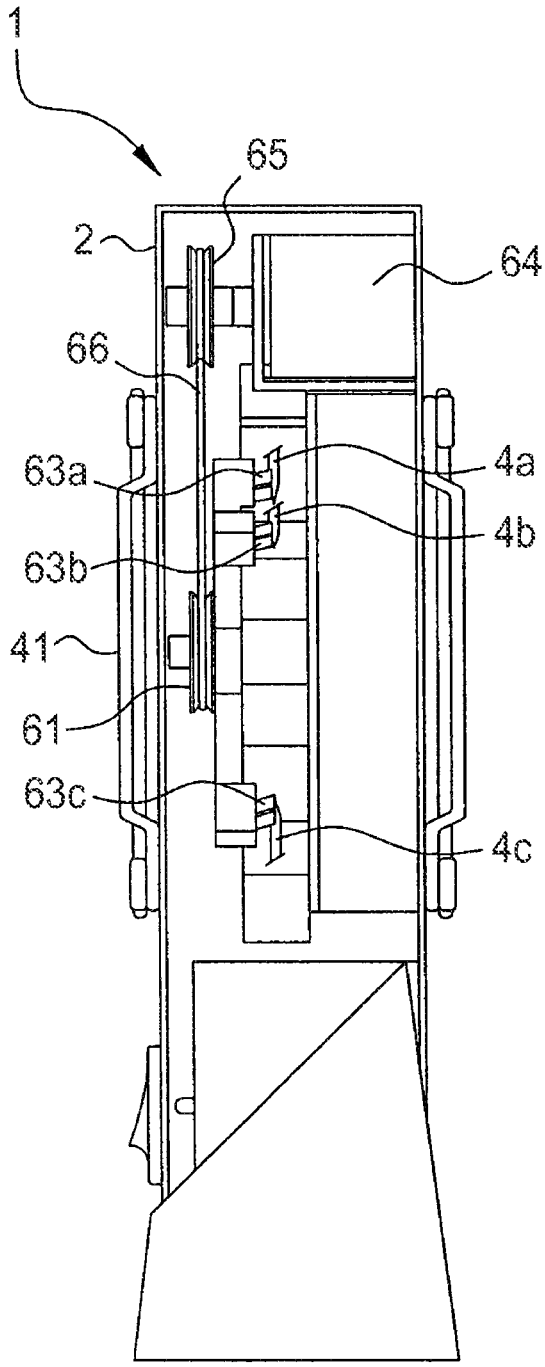
FIG. 2 is a cross-sectional view along II-II line in FIG. 1.

FIG. 1 is a top view of an ionizer according to a first embodiment of the present invention, and FIG. 2 is a cross-sectional view along II-II line in FIG. 1. In this embodiment, the ionizer is described as an example of a DC (direct-current) ionizer. The ionizer 1 includes a housing 2, a fan 3 contained in the housing 2, electrode needles (generally two pairs of needles) 4*a* to 4*d* for generating air ions by corona discharging, and high-voltage power supplies 5*a*, 5*b* for applying high voltage to the electrode needles 4*a* to 4*d*. The ionizer 1 also includes an opposing electrode 41 for generating corona discharging between the opposing electrode and each electrode needle. Each pair of electrode needles (in the embodiment, needles 4*a* and 4*c*; 4*b* and 4*d*) are located at opposing positions, and one needle of each pair (4*a* and 4*c*) is connected to the positive power supply 5*a*, and another needle of each pair (4*b* and 4*d*) is connected to the negative power supply 5*b*. By applying high voltage from the power supplies, corona discharging is generated between each electrode needle and the opposing electrode 41. The opposing electrode 41 is connected to ground via the housing 2. Air ions may be generated by corona discharging. The generated air ions is conveyed, toward an object (not shown) to be electrically neutralized, with an air flow generated by the fan 3.

The ionizer 1 includes a cleaning system 6 for cleaning each electrode needle. The cleaning system 6 has a rotating member 61 configured to coaxially rotate with the fan 3, a plurality of (four in the embodiment) rods 62*a* to 62*d* attached to the rotating member 61 such that each rod extends radially from the rotating member, and brushes 63*a* to 63*d* each attached to the end of each rods. The number of the rods or the brushes may be smaller than or equal to the number of the electrode needles. The more the number of brushes allows the range of rotating angle of the rotating member 61 to be reduced, resulting in a reduction of cleaning time. When one brush cleans a plurality of electrode needles, a cleaning effect may vary in each electrode needle, due to a fabrication error of each needle or brush. On the other hand, when one brush cleans one electrode needle, the positional relation between each brush and electrode may be adjusted individually. In addition, a material of bristles of the brush may include nylon, PP or metal, etc. Instead of the brush, a cleaning member, such as a non-woven cloth or the like, may be used.

The rotating member 61 is driven by an actuator 64, which is an electromagnetic solenoid in the embodiment. At this point, the term "actuator" means a component converting an input energy into a physical momentum, concretely, a mechanical element constituting a mechanical or electrical circuit. In the present invention, the actuator is activated by an electric signal or the like, so as to cause a bi-directional movement (for example, a rectilinear or rotational movement) of a certain member between two positions. Contrarily, the actuator does not include an electric motor or an engine, which continuously generates motive energy. As the actuator other than the electromagnetic solenoid, a hydraulic actuator or another actuator having a shape-memory metal and utilizing Joule heat generated by input current, may be used. These actuators basically generate momentum by being applied energy. When such an actuator is used in a device, the actuator is incorporated in a control system and controlled by an electric signal or the like.

In the illustrated example, the actuator or the electromagnetic solenoid 64 is positioned around the fan 3 or on the lateral side of the fan 3 in relation to the direction of the air flow generated by the fan 3. The power from the electromagnetic solenoid 64 is transmitted to the rotating member 61 via a coupling means 66. As the coupling means 66, a conventional belt, chain, wire or a crank mechanism may be used. It is advantageous to use a flat belt or a wire having a simple structure, in view of reducing a production cost and/or a weight of the ionizer. Further, since it is not necessary to position each brush relative to each electrode needle with high accuracy, there is no problem if the flat belt or the wire, which may occur a certain level of slip motion, is used.

In the invention, as described above, the electromagnetic solenoid 64 is positioned at the lateral side of the fan 3. Therefore, the thickness or the length in the direction of air flow of the ionizer 1 is not lengthened due to the existence of the actuator, whereby so called a thin-shaped ionizer may be constituted. Further, a component of the cleaning system, positioned in the air flow area by the fan 3, may be only the flat belt, the air resistance of which is substantially negligible. Accordingly, the amount of air flow of the ionizer is not reduced. As a result, it is not necessary to use a fan with high-capacity, whereby the ionizer may be compactly constituted.

Next, the operation of the cleaning system 6 will be explained. When a switch (not shown) for the electromagnetic solenoid 64 is turned on, the solenoid 64 is activated (in this case, an element such as a pulley 65 of the solenoid 64 is rotated). At this point, the pulley 65 is not continuously rotated in one direction, but exhibits the reciprocal motion within a predetermined angle range. The predetermined angle range is set such that each brush may clean each electrode needle in both directions opposed to each other and such that each brush may be positioned sufficiently away from each electrode needle so as not to be subjected to heat by discharging of the electrode needle when the solenoid 64 is not activated (or the actuation is terminated). The wider angle range may lengthen the cleaning time. On the other hand, when the angle range is too narrow, the brush cannot be positioned sufficiently away from the electrode needle. For example, four brushes are provided for four electrode needles, as illustrated, a typical angle range of each rod attached to the rotating member 61 is equal to or larger than 20 degrees. Also, the angle range is typically equal to or smaller than 60 degrees. Due to such a configuration, the brushes may be substantially integral with the rotating member 61 coupled to the element 65 of the electromagnetic solenoid 64 via the coupling means 66, and each brush may clean each electrode needle in both (right-and-left) directions.

When the rotation angle range of the rotating member 61 rotated by the electromagnetic solenoid 64 is 45 degrees, each rod is positioned at an initial position or a first position, where is away counterclockwise from corresponding electrode needle by 22.5 degrees before the activation of the solenoid 64. Upon the activation of the electromagnetic solenoid 64, the pulley 65 coupled to the solenoid 64 is clockwise rotated such that each brush is moved to and stopped at a second position where is away clockwise from corresponding electrode needle by 22.5 degrees, after contacting (or cleaning) the electrode needle. Then, the pulley 65 is reversely or counterclockwise rotated, each brush contacts or cleans corresponding electrode needle in the opposite direction, and returns to the initial position. Such a cleaning motion may be performed only in one direction or both directions, in one cleaning operation. When the cleaning motion is performed in both directions, both sides of each electrode needle may be cleaned, whereby the cleaning effect may be improved. By performing such a cleaning operation at a proper time interval (for example, once per 24 hours), each electrode needle may be kept clean sufficiently to exhibit its performance. In addition, the cleaning motion may include several times of reciprocating motion in one cleaning operation.

As described above, in the invention, the stopping position of the brush may be controlled by using the actuator having the simple motion, without using an intricate circuit or the like. As the electromagnetic solenoid 64, a mono-directional solenoid configured to rotate from a first position to a second position upon turning on a power switch (not shown) or inputting a control signal, and to return to the first position upon turning off the power switch or inputting another control signal. Alternatively, the electromagnetic solenoid may be a bi-directional solenoid configured to rotate in both directions by electromagnetic power. Since the mono-directional solenoid uses a spring or the like to return to the first position from the second position, a driving force for rotating the solenoid from the first position to the second position may be partially canceled by the spring force. Thus, the driving force may be different in each rotating direction. On the other hand, the bi-directional solenoid is rotated by the electromagnetic force in both directions, and therefore, a driving torque thereof is generally higher than that of the mono-directional solenoid. Also, the driving torque of the bi-directional solenoid is not so different in each direction. Further, the energy efficiency of the bi-directional solenoid is generally higher than that of the mono-directional solenoid, since the torque of the bi-directional solenoid is not canceled by the spring or the like. In addition, although the illustrated actuator is a rotary electromagnetic solenoid, a linear electromagnetic solenoid or an air solenoid may be used alternatively.

Figure 3:
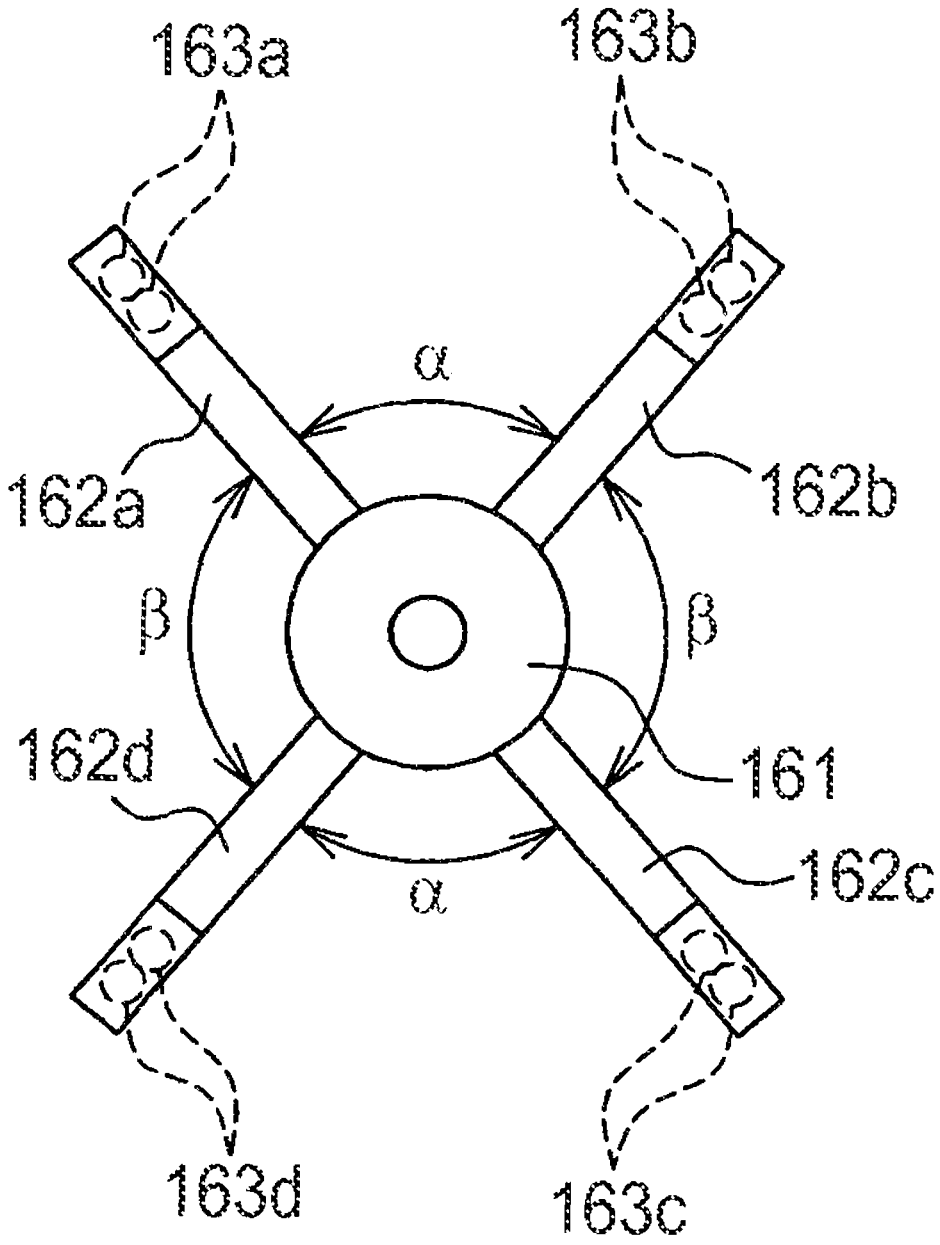
FIG. 3 shows a preferred modification of a cleaning system of the ionizer of FIG. 1.

During cleaning the electrode needles, if all of the brushes simultaneously contact the corresponding electrode needle, a large rotational resistance is generated at that moment. Therefore, in order to overcome the resistance, it is necessary to use an actuator having a relatively large torque and a power source therefore. In order to clean the electrode needle at a relatively low torque, the cleaning system may be constituted such that all of the brushes do not simultaneously clean (or contact) the electrode needles. Concretely, when the electrode needles are positioned even angular intervals as shown in FIG. 1, as in a modification shown in FIG. 3, angular intervals between neighboring rods attached to a rotating member 161 may not be equal (in the illustrated modification, four rods are not positioned at intervals of 90 degrees). Concretely, an angle α between rods 162*a* and 162*b*, or between rods 162*c* and 162*d*, may be somewhat smaller than 90 degrees, on the other hand, an angle β between rods 162*b* and 162*c*, or between rods 162*d* and 162*a*, may be somewhat larger than 90 degrees. In other words, brushes (for example, 163*a* and 163*c*) for cleaning the opposing electrode needles (for example, the needles 4*a* and 4*c*) are positioned away from each other by 180 degrees, so as to simultaneously clean the corresponding electrode needle. Each angle between each rod may be adjusted such that each brush may clean the corresponding electrode needle at the different timings. However, due to the configuration as shown in FIG. 3, the whole of the cleaning system, including the rotating member, the rods and the brushes, may be prevented from inclining (in FIG. 2) by the contact resistance against the electrode needle, whereby the rotation of the system and the cleaning effect may be stable. Obviously, when the electrode needles are not equally positioned, the same effect may be obtained by arranging the rods at even angular intervals.

Figure 4:
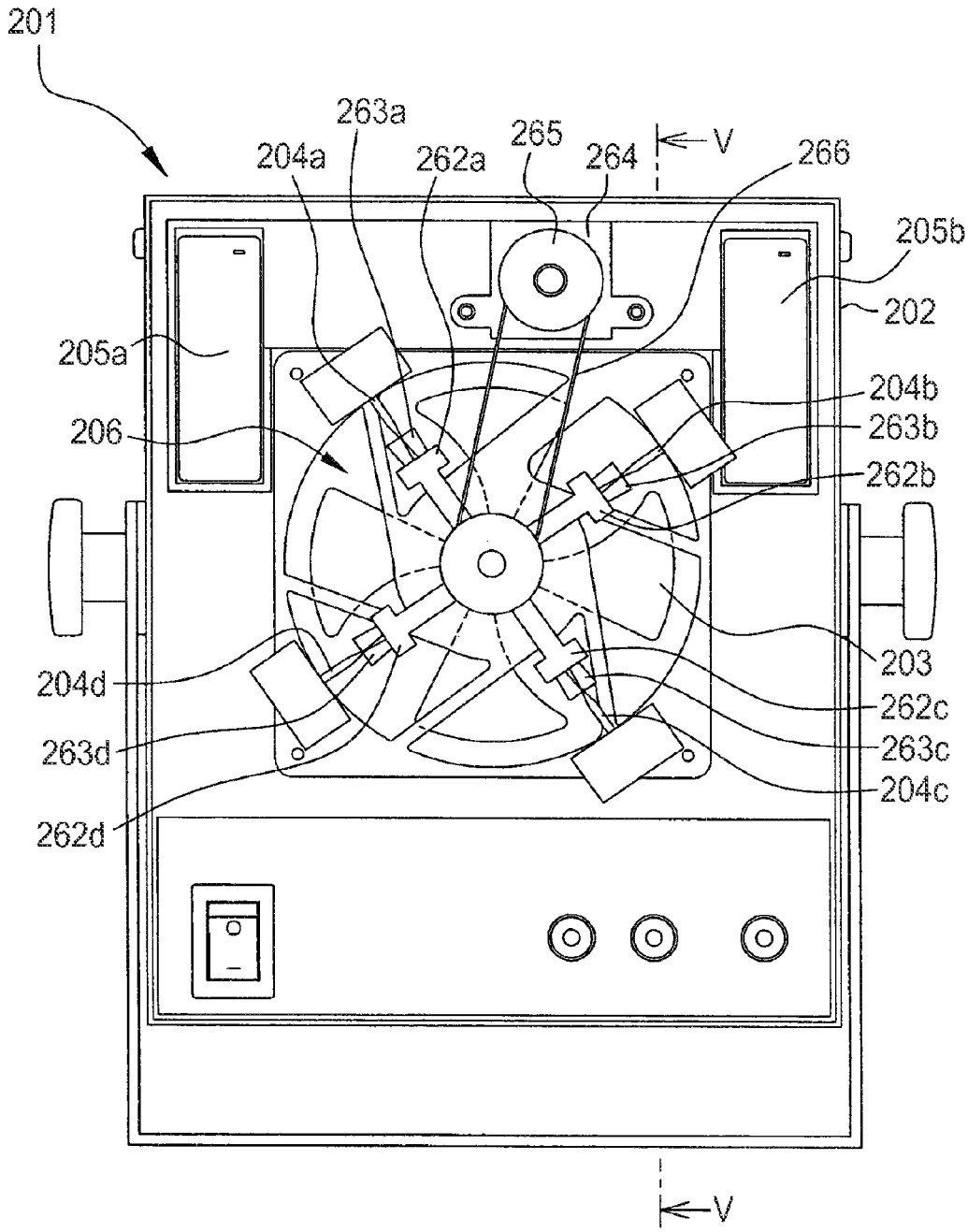
FIG. 4 is a top view of an ionizer according to a second embodiment of the present invention.
Figure 5:
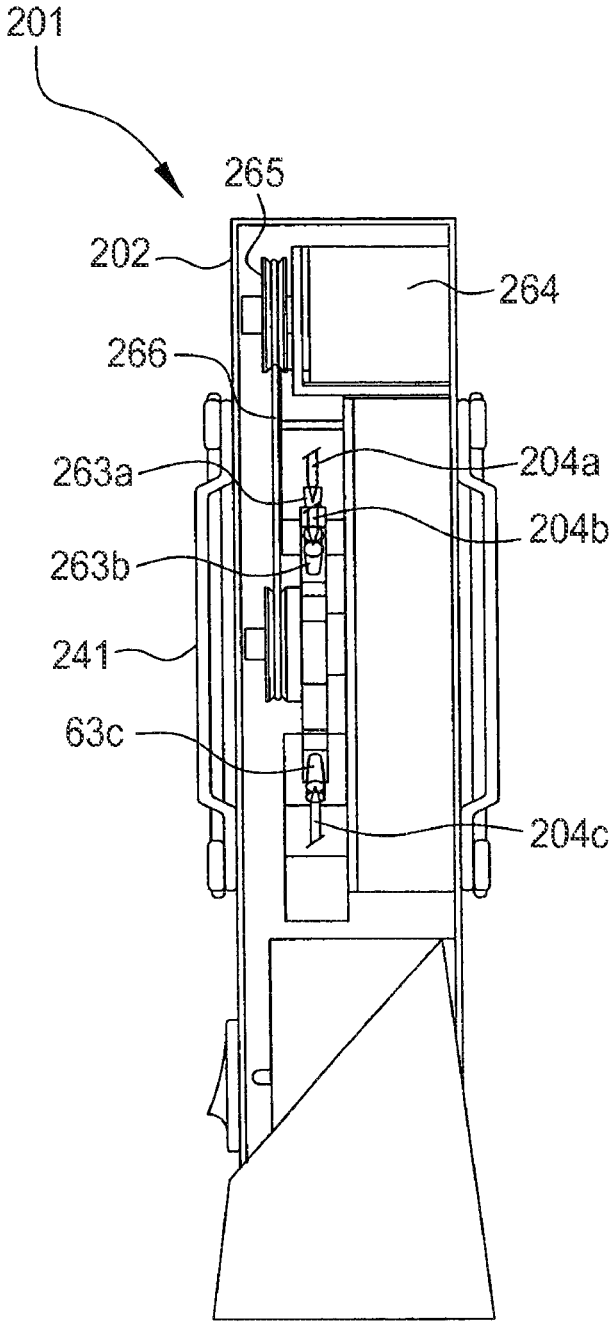
FIG. 5 is a cross-sectional view along V-V line in FIG. 4.

FIG. 4 is a top view of an ionizer according to a second embodiment of the present invention, and FIG. 5 is a cross-sectional view along V-V line in FIG. 4. In this embodiment, like reference numerals in the series 200 are used to indicate components corresponding to the first embodiment. In the second embodiment, the mounting direction of each brush 263*a* to 263*d* to each rod 262*a* to 262*d* is different from that of the first embodiment. Concretely, each brush extends from the end of each rod in the longitudinal direction of each rod, such that the extending direction of each electrode needle and the extending direction of bristles of corresponding each brush are generally coincide with each other. In the second embodiment, the thickness (or the length in the air flow direction) of a cleaning system 206 may be thinner than that of the cleaning system 6 of the first embodiment, whereby the thickness of the whole ionizer 201 may also be thinner. As the other components of the second embodiment may be the same as those of the first embodiment, the detailed description thereof is omitted.

In the above embodiments, a direct-current (DC) ionizer is explained. However, the invention may also applied to an alternating-current (AC) ionizer. In the AC ionizer, it is not necessary to arrange electrode needles at the opposed positions. For example, the Ac ionizer may have only one electrode needle. In the AC ionizer, all electrode needles may be electrically connected to one AC power supply, and corona discharging is generated between each electrode needle and an electrode opposed to each electrode needle.

The invention claimed is:

1. An ionizer comprising:

at least one electrode needle for generating air ions by corona discharging;

an air conveying means for generating an air flow by which the air ions are conveyed; and a cleaning system for cleaning the electrode needle, wherein the cleaning system comprises:

a cleaning member configured to come into contact with the electrode needle; and an actuator configured to move the cleaning member to the electrode needle back and forth from opposing clockwise and counterclockwise directions.

2. The ionizer as set forth in claim 1, wherein the actuator is positioned on the lateral side of the air conveying means in relation to the direction of the air flow by the air conveying means.

3. The ionizer as set forth in claim 1, wherein the cleaning member is a brush.

4. The ionizer as set forth in claim 1, wherein the actuator is a bi-directional solenoid.

5. An ionizer comprising:

at least two electrode needles for generating air ions by corona discharging;

an air conveying means for generating an air flow by which the air ions are conveyed; and a cleaning system for cleaning the electrode needles, wherein the cleaning system comprises a first brush configured to come into contact with one electrode needle and a second brush configured to come into contact with another electrode needle, and wherein the first and second brush are configured to come into contact with their corresponding electrode needle at different times from each other, and wherein the first and second brush are configured to come into contact with their corresponding electrode needle back and forth from opposing clockwise and counterclockwise directions.

6. The ionizer as set forth in claim 5, wherein the different brushes respectively contact one electrode needle and opposing another electrode needle at the same time.

7. The ionizer as set forth in claim 5, wherein the cleaning system comprises a rotating member rotatable about one axis and a plurality of rods radially attached to the rotating member, each having the first or the second brush, the plurality of rods being attached to the rotating member at different angle intervals.

* * * * *